United States Patent [19]

Bergström

[11] 4,164,271

[45] Aug. 14, 1979

[54] SYSTEM FOR INDICATING STOP LEVELS FOR AN ELEVATOR

[75] Inventor: Gunnar Bergström, Skellefteå, Sweden

[73] Assignee: Linden-Alimak AB, Skellefteå, Sweden

[21] Appl. No.: 860,240

[22] Filed: Dec. 13, 1977

[30] Foreign Application Priority Data

Dec. 14, 1976 [SE] Sweden ..... 7614047

[51] Int. Cl.[2] ..... B66B 1/36; B66B 1/50

[52] U.S. Cl. ..... 187/32; 187/29 R; 200/153 LA

[58] Field of Search ..... 187/1 R, 32, 33, 34, 187/35, 36, 29 R; 340/19 R, 21; 200/153 LA

[56] References Cited

U.S. PATENT DOCUMENTS

| | | | |
|---|---|---|---|
| 681,555 | 8/1901 | Kammerer | 187/32 |
| 1,219,061 | 3/1917 | Worthen | 187/32 |
| 1,505,699 | 8/1924 | Clancy et al. | 187/35 |
| 2,014,821 | 9/1935 | Staley | 340/19 R X |
| 2,018,958 | 10/1935 | Jones et al. | 200/153 LA X |
| 3,674,113 | 7/1972 | Richmon | 187/29 R |

*Primary Examiner*—Robert B. Reeves

*Assistant Examiner*—James L. Rowland

*Attorney, Agent, or Firm*—Schuyler, Birch, Swindler, McKie & Beckett

[57] ABSTRACT

A system for indicating the stop levels for an elevator car in a hoist shaft so as to transmit signals to the elevator machinery when a selected stop level is approached. Vertically aligned pins are provided projecting from the wall of the hoist shaft; at least one pin being provided for each stop level. The pins extend into the path of the arms of the a cross, fixed to one end of a shaft journaled in a box which is attached to the outside wall of the elevator car and cause the cross and shaft to rotate a quarter turn each time one of the arms of the cross engages one of the pins. The other end of the shaft carries a pinion gear which engages a movable rack connected to a linearly movable slide mounted on the elevator car. One end of the slide ends in a stairstep-like configuration, each step serving to actuate one microswitch in a transverse row of microswitches as the slide moves. The slide is advanced one step, corresponding to one story, for each quarter of a complete revolution by the cross when the elevator car is traveling through the hoist shaft. Thus, when each floor level is reached, the corresponding microswitch will be closed by the slide to transmit a signal to the elevator machinery.

7 Claims, 7 Drawing Figures

SYSTEM FOR INDICATING STOP LEVELS FOR AN ELEVATOR

The present invention is a system for indicating stop levels for an elevator.

Story selectors for elevators usually indicate the position of the elevator car in the hoist shaft by means of a counting apparatus, preferably located in the elevator car, which is advanced or retreated in pace with the story or stop levels passed by the elevator car. The count of the counting apparatus indicates the story at which the elevator car is at the moment. In elevators of the rack-and-pinion type the counting apparatus is advanced by a gear wheel engaging the rack. The more stories and/or the greater the height of the elevator, the more complicated such a counting apparatus will become so that, for a great number of stories or a considerable elevator height, it will be difficult to produce a counting apparatus operating with the accuracy desired. The gear wheel, having a diameter restricted by spatial considerations, basically has to complete one revolution during the travel of the elevator car from the lowest to the highest story. This means, obviously, an angular or peripherical distance on the wheel for each stop level, which is decreased for an increased elevator height and, thus, a correspondingly reduced accuracy in the stop location of the elevator car. This disadvantage—as well as others—is overcome by the invention in that the elevator car has a control element including a number of uniformly spaced arms extending into the hoist shaft, said control element being rigidly mounted on a horizontal center shaft which is journally mounted on the elevator car and being arranged, when rotating, to advance a member movably mounted on the elevator car for a consecutive operation of a set of switches, and that vertically aligned projections are provided in the hoist shaft to extend into the rotary path of the arms of the control element, at least one projection being provided for each stop level preferably two projections are provided for each stop location—the lower projection for the ascending movement of the elevator and the higher projection for the descending movement of the elevator—so that, when the elevator car is moving in the shaft, the control element is actuated by each projection to be advanced one arm pitch, i.e., an angle corresponding to the angle defined by adjacent arms, and, in its turn, displace said member so as to consecutively operate the switches for indicating the stop level at which the elevator car is located. By "indicating" is to be understood, in this connection, an indication of the location of the elevator car on one hand, and an indication to the drive machinery for the elevator on the other hand.

The invention will be described in more detail below while referring to the accompanying drawings.

Figure 1:
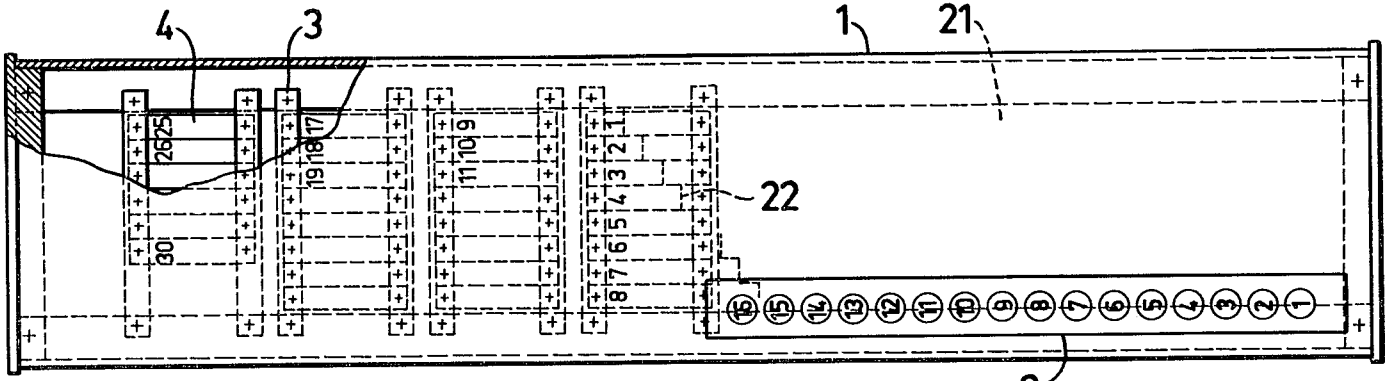
FIG. 1 is a plan view of the elevator apparatus according to the invention.
Figure 2:
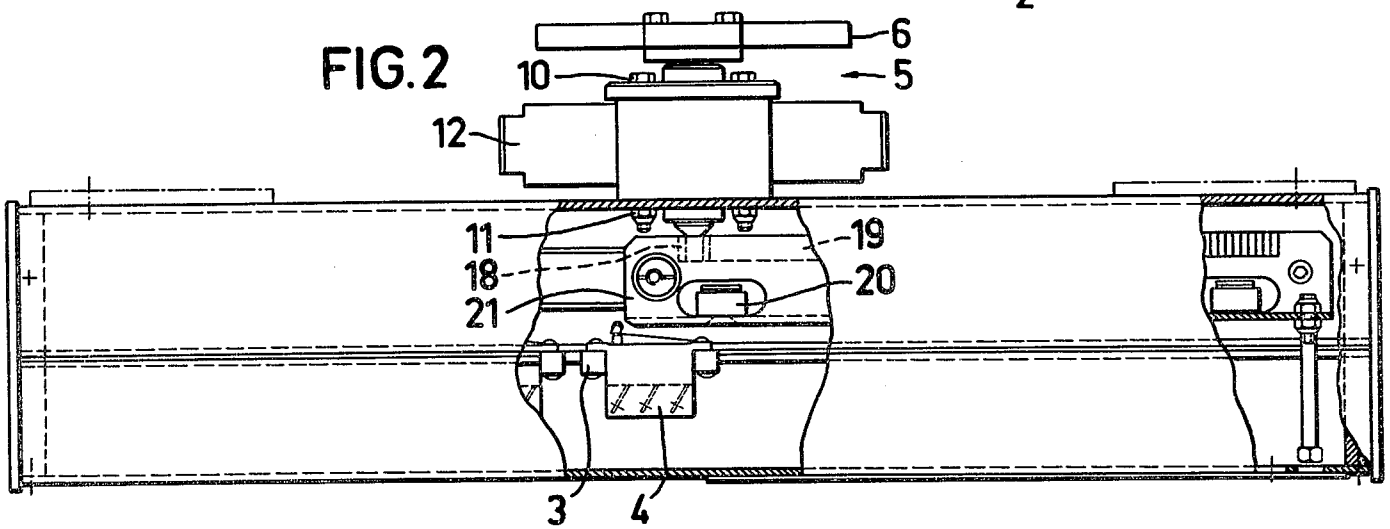
FIG. 2 shows, with parts broken away, a side view of the apparatus in FIG. 1.
Figure 7:
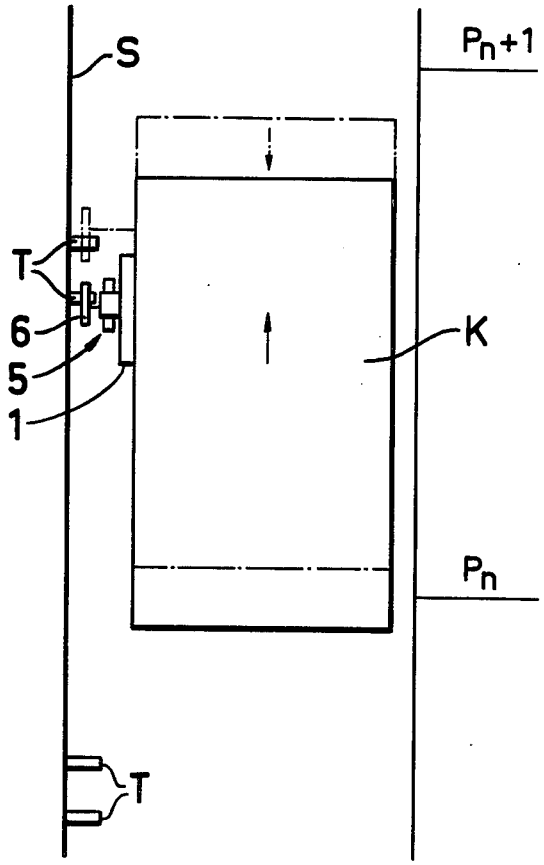
FIG. 7 is a very schematic view, not drawn to scale, of the complete system.

In FIGS. 1 and 2 there is shown an elongated box 1 which, normally in a standing position, is fixed externally to the wall of the elevator car (compare also with FIG. 7 where the elevator car K is shown in the hoist shaft S). An indicator panel 2 is provided internally of the wall of the elevator car opposite to the box 1 and presents, in the example shown, sixteen markings numbered 1 through 16 corresponding to the number of stories present. A lamp indicator of the conventional type may be used. Parallel bars 3 are, for the standing position of the box, mounted in pairs horizontally in the upper half of the box for carrying microswitches 4, one for each of the bottom and top stories and two for each intermediate story. The microswitches are distributed in four parallel rows, each row but one having eight switches, and sequentially numbered 1 through 30, i.e. corresponding to the sixteen stories assumed ($1+2\times14+1$).

Figure 4:
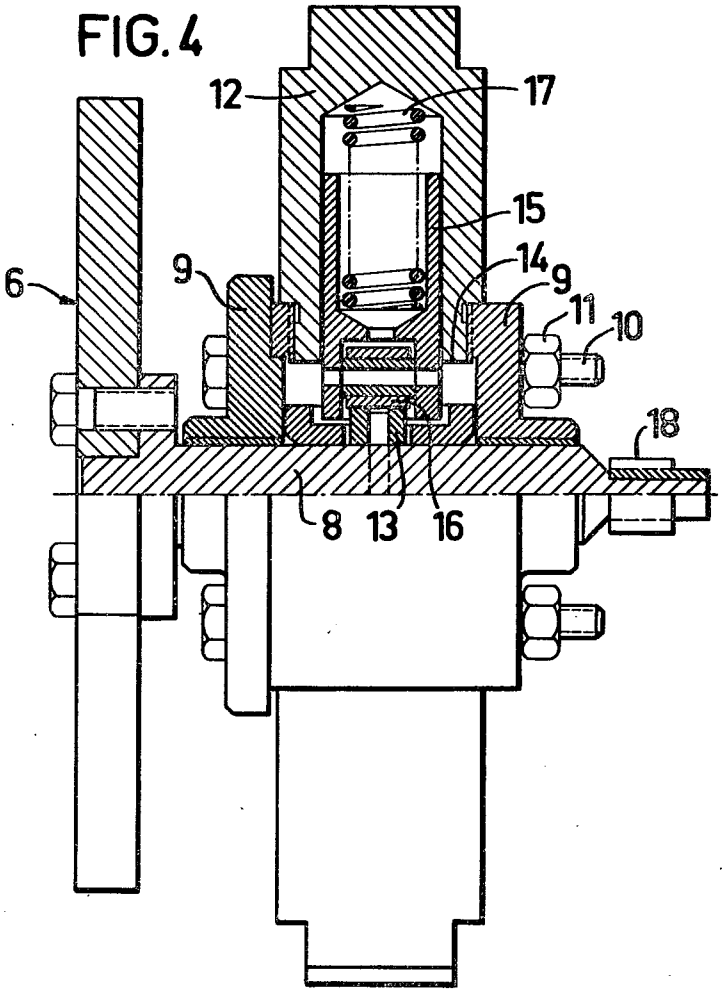
FIG. 4 shows, partly in section, a side view of the pulsator of FIG. 3.
Figure 3:
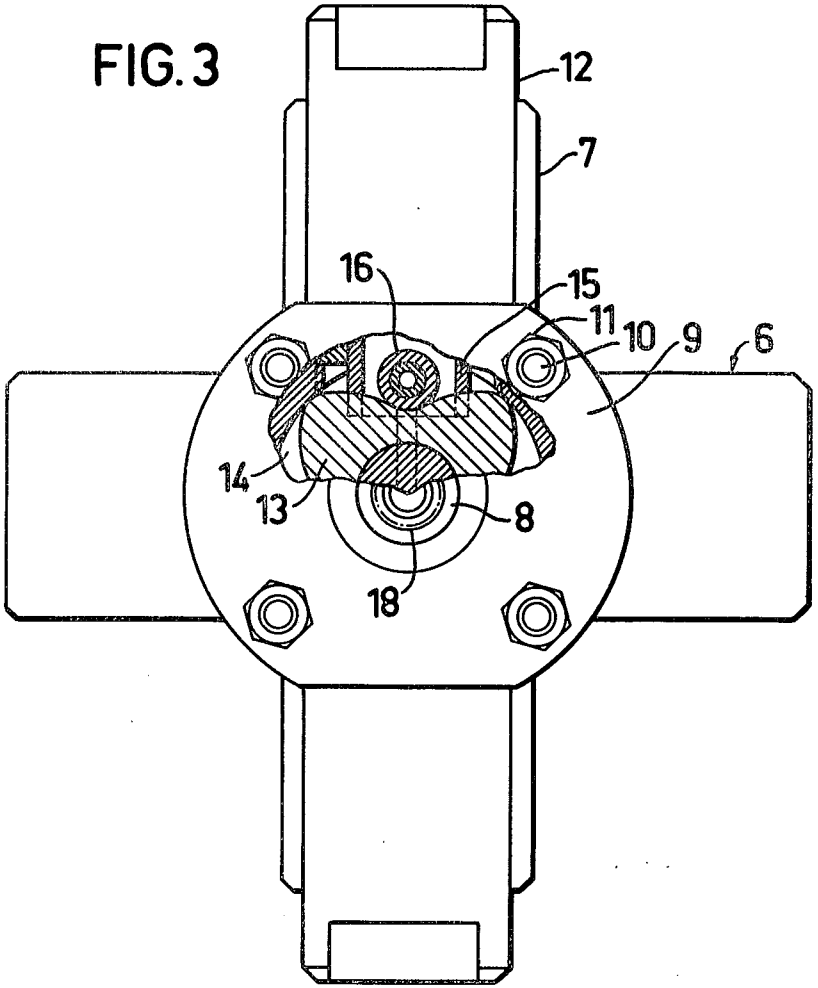
FIG. 3 is a front view of a pulsator included in said equipment.

From the box 1 there extends, according to FIG. 2, into the hoist shaft a pulsator, generally designated with 5, the components of which are shown in FIGS. 3 and 4. In these Figures there is shown a member 6 in the shape of a cross having four arms 7 and being fixed to a center shaft 8 mounted for rotation in bearing brackets 9 which, by means of screws 10 and nuts 11, fix a snap-detent housing 12 to the box wall (see FIG. 2).

In the center of the housing 12 the shaft 8 supports a cam disk 13. The cam disk has the general shape of a cushion having concave sides, the corners of the cushion slidably engaging the inside of a circular recess 14 in the housing into which recess two diametrically opposite bores open. In each of the bores a sleeve 15 is slidably mounted the inner end of which supports a roll 16. By means of a compression spring 17 the roll is urged against the cam disk 13 and forces it to a stable position with the roll resting in the lowest point in a concave portion of the cam disk, as shown in the Figure. It is apparent from the Figure that the cross 6, when rotated through an angle exceeding 45° snaps into a distinct position, exactly corresponding to a quarter of a complete revolution.

Figure 5:
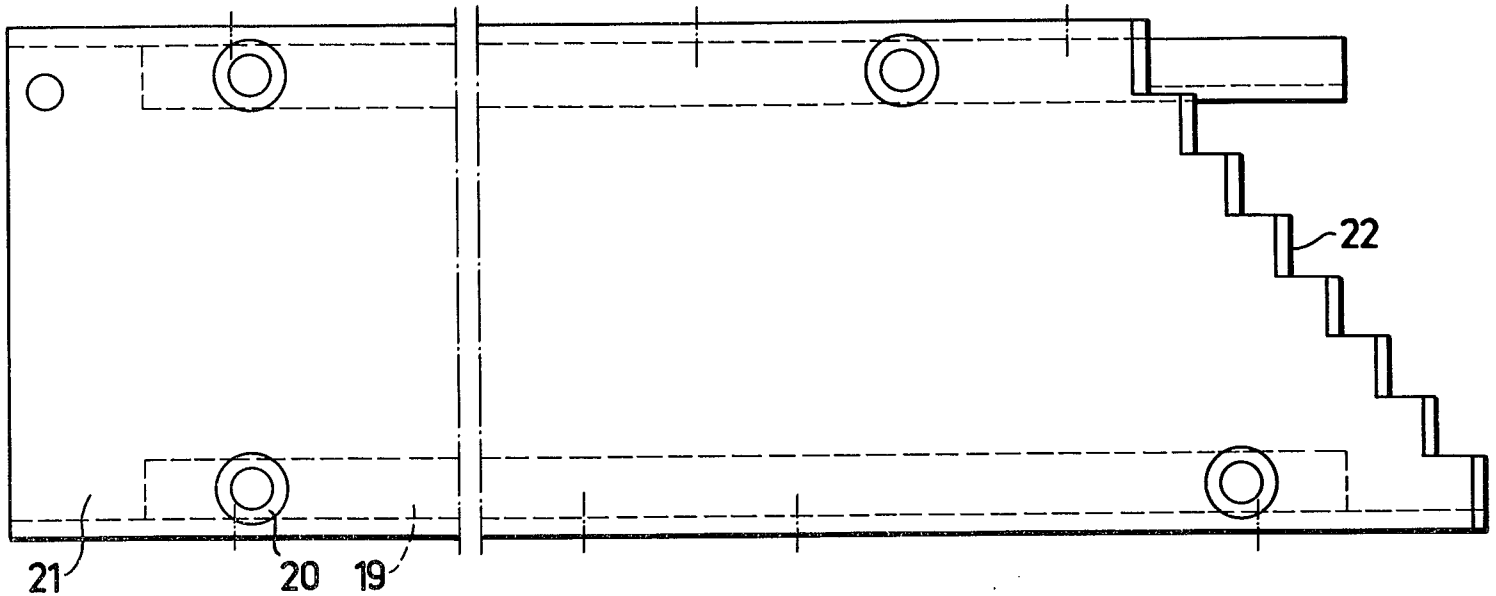
FIG. 5 is a plan view of a slide included in said equipment.
Figure 6:
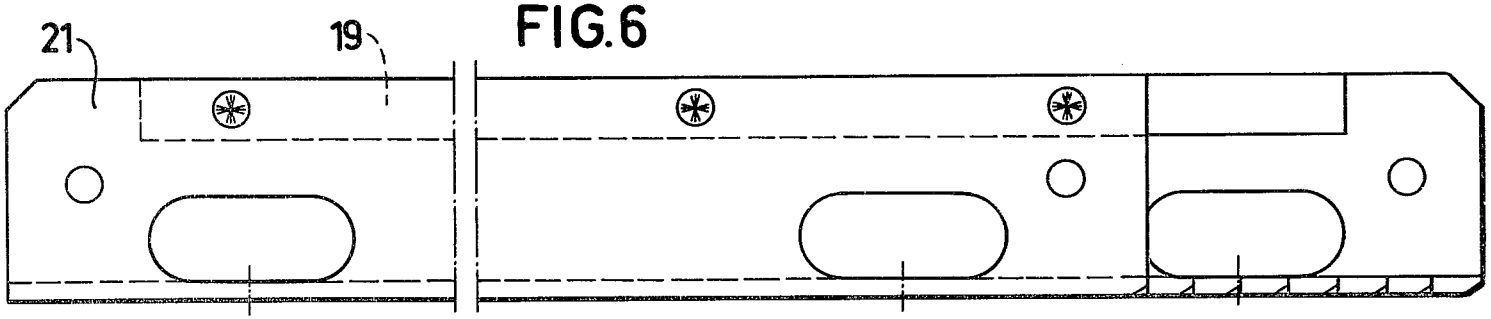
FIG. 6 is a side view of the slide of FIG. 5.

The shaft 8 of the cross 6 carries at its end projecting into the box 1 a pinion gear 18. This pinion, as shown in FIG. 2, engages a rack portion 19 of a slide 21 mounted on rolls 20. The slide is shown separately in FIGS. 5 and 6. In these Figures the rolls 20 as well as the rack portion 19 are again to be found. One end of the slide is, in the example described, stepwise reduced in eight steps 22 corresponding to the previously mentioned eight microswitches 4 in each row, as shown in FIG. 1. The coordination of slide steps and microswitches is indicated by steps 22 in dashed lines in FIG. 1 where the highest step faces the switch No. 1 and the lowest faces the switch No. 8 in the first (lowest) row.

Finally, there project, as shown in FIG. 7, from a wall in the hoist shaft S, vertically aligned pins T, one—or preferably (as shown) two adjacent pins—for each step level $P_n$, $P_{n+1}$ and so on having their ends extending into the rotary path of the cross 6 of the pulsator 5.

The microswitches are connected through a relay system to the drive machinery of the elevator for controlling the travel of the elevator car. This system will not be described in this connection as it may be a purely conventional one. However, the arrangement of the invention including studs in the hoist shaft for driving a pulsator for operation of microswitches may replace prior art systems designed for the same purpose. For example, the system of the invention may replace a prior art system based on permanent magnets positioned at different levels in the shaft and laterally displaced with respect to each other, each of said magnets being vertically aligned with a different magnetic switch in the elevator car for operation of the same. Thus, the number of selectively operative permanent magnets—and consequently the number of stories traversed by the elevator—necessarily is restricted by the width of the shaft. With the invention such geometrical restriction is overcome, as is clear from the following description of the operation. The greatest advantage, however, is that the height of the elevator—or number of stories traversed by the elevator—is of no importance to the accuracy of halting at the stop levels.

It is assumed that the elevator car K in FIG. 7 is ascending in the hoist shaft S and has arrived to the position indicated by full lines, i.e. with the bottom of the elevator car approaching the destination stop level $P_n$, say $P_6$. During the travel five stop levels have been passed, and for each stop level the shaft pins associated with that level have rotated the cross 6 of the pulsator 5 a quarter of a complete revolution, each time advancing the stepped slide one step. This means that the slide already has consecutively closed the microswitches Nos. 1–8 in the first or lowest row (the right one in FIG. 1) and then, by its highest step, has started to close the switch No. 9 in the second row. Up to this point the stop level indicators for floors Nos. 1–5 have been passed and the elevator machinery is still driving the elevator car upwards. In the elevator car position shown the cross is just about to rotate one more quarter of a revolution as a result of the engagement of one of the cross arms with the lower of the pins T so that the second highest step of the slide closes the switch No. 10, at which time the braking of the elevator car may be triggered (in the same manner as utilized in prior art systems whereby the elevator car will be able to stop exactly at the stop location for the sixth floor $P_6$. The conditions will be reversed when the elevator car is descending and approaches the stop level $P_n$, again level $P_6$, from above (dash-and-dot-line position). The slide is retracted stepwise from the switches allowing these to resiliently return to their original opened position. The marking for the stop level $P_{n+1}$, i.e. the 7th floor, has just been passed, and the braking of the cage can be started after the upper one of the pair of pins T has rotated the cross of the pulsator and the switch No. 11 has opened.

From the foregoing description it is apparent that the system of the invention can be used with an arbitrarily great number of stories while maintaining the same accuracy in the indication of each story and, consequently, also securing accuracy in the movement of the elevator car. The number of stories is only limited by the size of the box.

Many different modifications of the embodiment shown and described are within the scope of the invention, especially as regards the form of the pulsator and the slide as well as the positioning of the switches. Thus, the cross-shaped member shown could be replaced by a rotary element having fewer, as well as more, than four arms in combination with a corresponding modification of the snap-detent mechanism for forcing said element to a well-defined position after it has been rotated past an unstable point. The step or "staircase" configuration of the end of the slide could basically be replaced by an inclined straight line, even if steps are to be preferred on account of the more distinct actuation of the switches. Alternatively, the slide could be formed with its end line perpendicular to the longitudinal axis of the slide, and the microswitches could be consecutively displaced in the direction of the axis of the slide. The only essential criterion is that an angle always be formed between the general transverse extension of the slide end and the line of microswitches. These switches may, moreover, be replaced by other circuit-making and -breaking means for mechanical, magnetical or electrical actuation, for example, by gap-contacts which can be bridged by the slide.

What I claim is:

1. A system for indicating the stop levels for an elevator car traveling in a hoist shaft, said system comprising:

a rotatable control element comprising a horizontal shaft journally mounted on the elevator car and a plurality of uniformly spaced, radial arms extending from said control element shaft into the hoist shaft;

a linearly movable slide mounted on said elevator car;

transmission means connecting said control element and said slide for moving said slide linearly in response to rotation of the control element;

a plurality of projections disposed in said hoist shaft, at least one projection being associated with each stop level for the elevator car, said projections extending into the path of the arms of the control element such that as the elevator car moves past each projection, the projection will engage one of said arms and cause the control element to rotate through an angle equal to the angle between adjacent arms, and at least one line of switches positioned in the path of said slide, each line of switches forming an angle with a line generally defined by the adjacent end of the slide such that the switches are successively actuated as the slide moves;

whereby each rotation of the control element in response to engagement of one of said arms by one of said projections will move the slide member one step and actuate one of the switches to indicate the stop location associated with the engaged projection.

2. A system according to claim 1 wherein each line of switches is perpendicular to the direction of movement of said slide.

3. A system according to claim 2 wherein the end of said slide adjacent said line of switches is configured as a series of uniform steps, one step being provided for each switch in the line of switches.

4. A system according to claim 1 comprising a plurality of parallel lines of switches, each line of switches indicating a fraction of the total number of stop levels for the elevator car.

5. A system according to claim 1 wherein said transmission means comprises a pinion gear connected to the control element and a mating rack connected to the slide.

6. A system according to claim 1 wherein the control element has four arms forming a regular cross.

7. A system according to claim 1 wherein the number of switches successively actuated by the linearly movable slide is greater than the number of arms on the rotatable control element so that the control element must make more than one complete revolution for all of the switches to be actuated.

* * * * *